US007506482B2

(12) United States Patent
Sorkin

(10) Patent No.: US 7,506,482 B2
(45) Date of Patent: Mar. 24, 2009

(54) CONCRETE REINFORCING BAR SUPPORT WITH BAR RETAINER MEMBERS

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 224 days.

(21) Appl. No.: 11/418,574

(22) Filed: Aug. 1, 2006

(65) Prior Publication Data

US 2008/0028717 A1 Feb. 7, 2008

(51) Int. Cl.
*E04C 5/16* (2006.01)

(52) U.S. Cl. ..... 52/685; 52/686; 52/719

(58) Field of Classification Search ..... 52/684–686, 52/677, 719; 404/135, 136
See application file for complete search history.

(56) References Cited

U.S. PATENT DOCUMENTS 3,449,882 A * 6/1969 Bigglestone et al. ..... 52/689
3,694,988 A * 10/1972 Skold ..... 52/678
3,944,177 A * 3/1976 Yoda ..... 248/74.2
3,980,263 A * 9/1976 Okuda ..... 248/73
D245,145 S * 7/1977 Berry ..... D8/356
4,295,618 A * 10/1981 Morota et al. ..... 248/73
4,598,523 A * 7/1986 Tolliver ..... 52/685
4,614,321 A * 9/1986 Andre ..... 248/74.2
4,617,775 A * 10/1986 Padrun ..... 52/684
4,840,334 A * 6/1989 Kikuchi ..... 248/73
5,400,562 A * 3/1995 Bahr ..... 52/684
5,791,816 A * 8/1998 McCallion ..... 404/136
6,112,494 A * 9/2000 Hardy et al. ..... 52/685
6,216,986 B1 * 4/2001 Kwilosz ..... 248/74.1
6,216,987 B1 * 4/2001 Fukuo ..... 248/74.2
6,276,108 B1 * 8/2001 Padrun ..... 52/684
6,557,317 B2 * 5/2003 Sorkin ..... 52/684
6,663,316 B1 * 12/2003 Harris ..... 404/136
6,684,594 B1 * 2/2004 Sorkin ..... 52/685
6,684,595 B1 * 2/2004 Sorkin ..... 52/685
6,837,017 B2 * 1/2005 Hardy et al. ..... 52/685
7,241,071 B2 * 7/2007 Carraher et al. ..... 403/164
7,328,538 B2 * 2/2008 Trangsrud ..... 52/682

* cited by examiner

*Primary Examiner*—Robert J Canfield
*Assistant Examiner*—Charissa Ahmad
(74) *Attorney, Agent, or Firm*—Egbert Law Offices PLLC

(57) ABSTRACT

A concrete reinforcing bar support has a base, a support structure extending upwardly from the base so as to define a channel formed in an upper surface thereof, a first clamping structure affixed to the support structure on one side of the channel, a second clamping structure affixed to the support structure on the opposite side of the channel, and a rebar retainer positioned between the clamping structures for retaining the rebar in the channel. The rebar retainer includes first and second retainer members movable between a first position spaced away from each other and a second position overlying a portion of the rebar when the rebar is placed in the channel. Each of the retainer members has a generally S-shaped cross-section configuration.

7 Claims, 2 Drawing Sheets

CONCRETE REINFORCING BAR SUPPORT WITH BAR RETAINER MEMBERS

RELATED U.S. APPLICATIONS

Insert the attached page

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to devices for use in connection with construction. More particularly, the present invention relates to a reinforcing bar chair apparatus for use in reinforced concrete construction. Furthermore, the present invention relates to intersectional chairs used with reinforced concrete construction.

BACKGROUND OF THE INVENTION

In reinforced concrete construction applications, such as highways, floors, or walls of buildings, spacer devices, commonly referred to as chairs, are required for supporting and maintaining reinforcing rods or bars which are positioned in the area where concrete is to be poured. These reinforcing rods are sometimes referred to as "rebars". Depending on such parameters, such as the total surface area and the thickness of the end product of concrete, reinforcement is mandated in varying degrees by building codes. One such method of reinforcement involves a steel mesh, while in major concrete construction, such as highways and high-rise buildings, reinforcing rods of various diameters, typically one-half inch or more, are required. In addition, on such jobs, the reinforcing bars may be positioned in spaced layers due to the thickness of the floor. In some installations, a first layer of rebar is provided, with the reinforcing rods or rebars in spaced parallel relationship, and generally parallel to the surface on which the concrete is to be poured. A second layer of rebar is then added, with the orientation of the second layer perpendicular to the first layer, thus forming a grid or lattice work. After the reinforcing bars or lattice work is prepared, the concrete is then poured over this grid or framework, which is ultimately embedded within the highway floor or wall.

For a concrete floor on a prepared surface, spacers or chairs are utilized for providing the vertical separation of the rebar grid from the surface on which the concrete is to be poured. The prepared surface may be a wood, plywood, or foam structure or a compacted surface, the latter of which my be provided with a layer of compacted sand, with a plastic sheet covering thereon providing a moisture barrier. Spacers or chairs are then positioned on the prepared surface for supporting the rebars in a plane generally parallel to the prepared surface. Typically, with modern building codes, a spacer is needed for every linear foot of the rebar.

With rebar spacers or chairs, one common problem is occasioned by the number of different sizes required to be maintained by a supplier to accommodate different thicknesses of poured concrete, such as two-inch, three-inch, four-inch, etc. and many intermediate fractional sizes. Another common problem with rebar spacers has been encountered in the method of securing the rebar to the chair or spacer, with twisted wire being the most common method. This particular problem is more acute when mutually perpendicular layers of rebar are coupled to the same chairs or spacers. With wire connections, a first strip of wire secures the first layer and a second strip of wire secures the perpendicular layer of rebar. With any metal or wire within the reinforcing bar grid work, there is a problem with rusting or decomposing of the wire or metal components.

In the past, various patents have issued relating to these chair supports for reinforcing rods. In particular, the present inventor is the owner of U.S. Pat. Nos. 5,555,693 and 5,791,095 for such chairs. Each of these chairs has a receiving area with a horizontal section and a generally parabolic section extending transverse to the horizontal section. A plurality of separate legs extends downwardly from the receiving area. Each of the legs has a foot extending horizontally outwardly therefrom. The receiving area and the plurality of legs are integrally formed together of a polymeric material.

U.S. Pat. No. 3,788,025, issued on Jan. 29, 1974 to S. D. Holmes, describes a chair for supporting in right angular relation two reinforcing rods used in construction. The chair has a lower arched base part and an upper rod supporting part integral with the base. The base is an arched support with means for providing lateral, longitudinal, vertical support and strength. The rod supporting part comprises two spaced apart arms, the lower parts of which form a saddle for receiving one reinforcing rod and the upper part for each of which is formed by two separate spaced upstanding inwardly concave arms, the upper ends of which are spaced to provide an opening through which a second reinforcing rod, arranged at a right angle to the first rod, may be introduced.

U.S. Pat. No. 3,673,753, issued on Jul. 4, 1972 to G. C. Anderson, teaches a concrete reinforcing bar support in which a base supports an upright pedestal. A lower clamping portion is supported by the pedestal which has a first rod-receiving open passageway therethrough. Resilient detents extend from the lower clamping portion to retain a reinforcing rod disposed through the first passageway. An upper clamping portion is provided which includes a pair of hook members extending from the lower clamping portion. Each of the hook members has a mouth opening in the same direction to define a second rod-receiving passageway which is normally disposed to the first passageway.

U.S. Pat. No. 4,835,933 issued on Jun. 6, 1989 to F. Portion Yung, describes a spacer assembly which includes a spacer with a body having a base portion with a generally centrally disposed support post portion. One end of the support post portion is formed as a planar surface with a centrally located generally concave saddle portion configured for receiving a reinforcing bar. The planar surface is provided with apertures therethrough on both sides of the saddle. A clamp member is provided for simultaneously securing mutually perpendicular rebars to the chair. The clamp member is a generally U-shaped lower portion, with the depending arms thereof in spaced generally parallel relationship for engaging a first bar within the saddle. A generally identical pair of hook arms extends upwardly from the bight portion. The hook arms are oriented for engaging a second rebar in an orientation perpendicular to the first rebar engaged within the saddle portion.

U.S. Pat. No. 5,893,892, issued on Apr. 13, 1999 to Hardy, Jr. et al, teaches an apparatus for fixating and elevating an interconnected rebar lattice having individual longitudinal and transverse rebar intersections. The apparatus includes a holding portion having an open-ended recess with two opposing walls being generally U-shaped. The recess has longitudinal access and is sized and shaped to receive a longitudinal rod. An arc-shaped portion extends laterally outwardly from each opposing wall and perpendicular to the longitudinal access of the recess. The arc-shaped portion includes a recess and an opposing wall with each wall including a snap-type lock. A locking member has a generally arc-type portion and includes a snaptype lock for attaching to the arc-type portion and engaging with the snap-type lock of the arc-type portion. A leg portion extends downwardly from the holding portion and is integrally attached to a base.

It is an object of the present invention to provide a bar support that can retain a rebar in a channel thereof.

It is another object of the present invention to provide a rebar-retaining bar support in which the rebar can be easily introduced into the channel and automatically retained within the channel.

It is a further object of the present invention to provide a bar support adapted for use at intersections of rebars.

It is another object of the present invention to provide a bar support that can be placed on various flat surfaces.

It is another object of the present invention to provide a bar support that can be easily snap-fitted onto and locked around a reinforcing bar.

It is another object of the present invention to provide a bar support with a load-resistant stable support structure.

It is a further object of the present invention to provide a bar support which is corrosion-proof.

It is still another object of the present invention to provide a reinforcing bar support which is easy to use, easy to manufacture and relatively inexpensive.

These and other objects and advantages of the present invention will become apparent from a reading of the attached specification and appended claims.

BRIEF SUMMARY OF THE INVENTION

The present invention a reinforcing bar support comprising a base, a support structure extending upwardly from the base so as to define a channel formed at an upper surface thereof, a first clamping structure affixed to the support structure on one side of the channel, a second clamping structure affixed to the support structure on an opposite side of the channel, and a rebar retaining means positioned between the first and second clamping structures for retaining a first rebar within the channel. The channel extends in a direction and has a size suitable for receiving the rebar therein. Similarly, the first and second clamping structures have a size suitable for receiving a second rebar therein extending in a direction transverse to the first rebar.

In the present invention, the rebar retainer means includes a first retainer member positioned adjacent the first clamping structure and a second retainer member positioned adjacent the second clamping structure. Each of the first and second retainer members are movable between a first position spaced away from each other and a second position overlying a portion of the first rebar when the rebar is placed in the channel. Each of the first and second retainer members is a generally S-shaped cross-section member with a curved section and a tail section. The support structure has a slot formed therein adjacent each of the first and second clamping structures. The tail section is received within the slot when the retainer member is in the second position. The S-shaped cross section member is detachably secured to the clamping structure when in the first position so as to define a space between the first and second retainer members such that the first rebar can be introduced between the first and second retainer members. Each of the first and second retainer members also includes a tang that is affixed to a back surface of the retainer member and to the clamping structure. The tail section is free of the slot when the first and second retainer member are in their first position. The S-shaped member also has a finger extending outwardly from a surface thereof into the space between the first and second retainer members. The finger serves to contact a surface of the rebar as the rebar is moved toward the channel.

In the present invention, each of the first and second clamping structures includes a first curved element extending upwardly from the support structure and a second curved element extending upwardly from the support structure in spaced relationship to the first curved element. The first curved element faces the second curved element so as to define a rebar-receiving space therebetween. In the preferred embodiment of the present invention, the first curved element is offset from the second curved element along a longitudinal direction of the second rebar.

The base, the support structure, the first and second clamping structures and the rebar retainers are integrally formed together of a polymeric material.

The present invention is also a device for retaining the rebar in a channel of a bar support. This device comprises a first member having an upper curved section and a tail section and positioned on one side of the channel, and a second member having an upper curved section and a tail section and positioned on an opposite side of the channel. The upper curved section of the first member generally faces the upper curved section of the second member. Each of the first and second members is movable between a first position spaced from each other to a second position overlying a portion of the rebar when the rebar is placed in the channel. Each of the first and second members has a generally S-shaped cross-section configuration. The tail sections are respectively received in the slots when in the second position. This embodiment of the present invention also can be used in bar support that are not intersectional bar supports.

The present invention is further a method of affixing a rebar in a channel of a bar support that comprises the steps of: (1) forming the bar support so as to have a first retainer member on one side of the channel and a second retainer member on an opposite side of the channel; (2) moving the rebar toward the channel such that the surface of the rebar contacts a surface of the curved section of the first and second retainer members; and (3) urging the rebar further toward a surface of the channel such that the curved surface of the first and second retainer members overlies a portion of the rebar and such that the tail sections of the first and second retainer members are respectively received within the slots. Each of the first and second retainer members has a curved section and a tail section. The bar support includes a first slot on one side of the channel and second slot on an opposite side of the channel.

In the method of the present invention, the step of forming comprises: (1) detaching the first retainer member in an upward position on one side of the channel; and (2) affixing the second retainer member in an upward position on an opposite side of the channel such that the curved sections of the first and second retainer members are spaced from each other by a distance such that the rebar can be moved therebetween.

The step of urging includes detaching the first retainer member from one side of the channel and detaching the second retainer member from opposite side of the channel. In the method of the present invention, the step of forming includes forming a finger extending from curved the section of the first retainer member in a direction toward the curved section of the second retainer member, and forming a finger extending from the curved section of the second retainer member in a direction toward the curved section of the first retainer member. The rebar contacts the fingers during the step of moving so as to cause the tail sections to enter the slots.

DETAILED DESCRIPTION OF THE INVENTION

Figure 1:
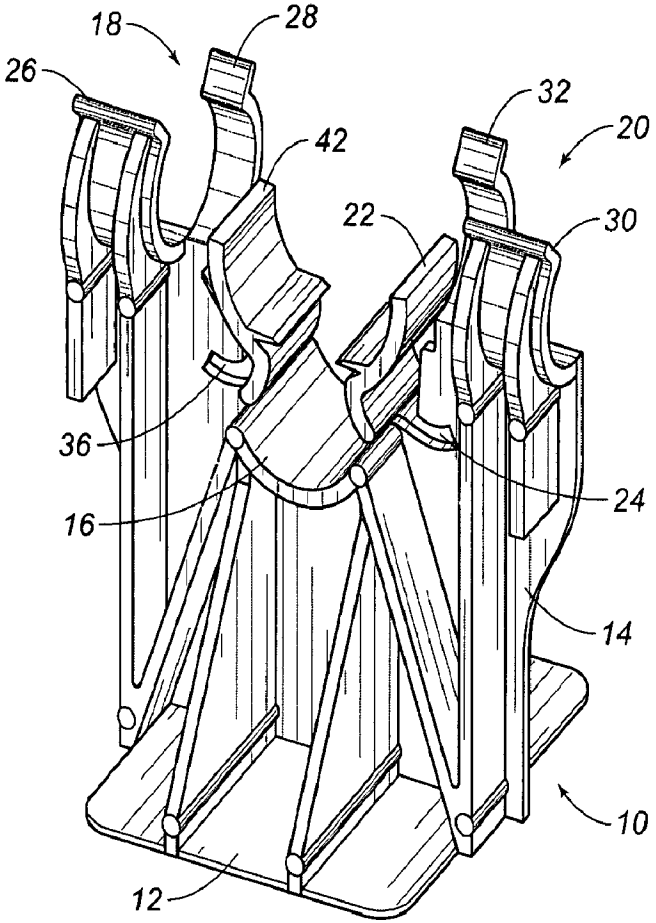
FIG. 1 is a perspective view of the preferred embodiment of the present invention.

Referring to FIG. 1, there is shown the bar support 10 in accordance with the preferred embodiment of the present invention. The bar support 10, as illustrated in FIG. 1, is an "intersectional" bar support in which one rebar can be placed so as to extend in transverse relationship to another rebar. Within the concept of the present invention, the technique for retaining a rebar within the channel can be equally applied in association with non-intersectional bar supports.

The bar support 10 includes a base 12 having a support structure 14 extending upwardly therefrom. The support structure 14 defines a channel 16 extending in a direction and having a size suitable for receiving a rebar therein. A first clamping structure 18 is affixed to the support structure 14 on one side of the channel 16. The first clamping structure 18 has a surface suitable for receiving a second rebar therein extending in a direction transverse to the rebar that is received within the channel 16. A second clamping structure 20 is affixed to the support structure 14 on an opposite side of the channel 16 from the first clamping structure 18. The second clamping structure 20 also has a surface suitable for receiving the second rebar therein. A rebar retainer 22 is positioned between the first clamping structure 18 and second clamping structure 20. A slot 24 is formed adjacent to the second clamping structure 20 and cooperative with the rebar retainer 22 during the operation of securing the rebar within the channel 16. Another rebar retainer and associated slot are formed adjacent to first clamping structure 18. This structure is illustrated, in greater detail, in FIGS. 2-4.

The first clamping structure 18 includes a first curved element 26 extending upwardly from the support structure 14 and a second curved element 28 extending upwardly from the support structure. The first curved element 26 and the second curved element 28 serve to define a rebar-receiving space therebetween. The first curved element 26 is offset from the second curved element 28 along a longitudinal direction of the second rebar. Similarly, the second clamping structure 20 includes a first curved element 30 and a second curved element 32. Each of the curved elements 30 and 32 also extend from the support structure 14 so as to define a rebar-receiving space therebetween. The first curved element 30 and the second curved element 32 are offset from each other along a longitudinal direction of the second rebar.

In the present invention, the base 12, the support structure 14, the first clamping structure 18, the second clamping structure 20 and the rebar retainer 22 are integrally formed together of a polymeric material.

Figure 2:
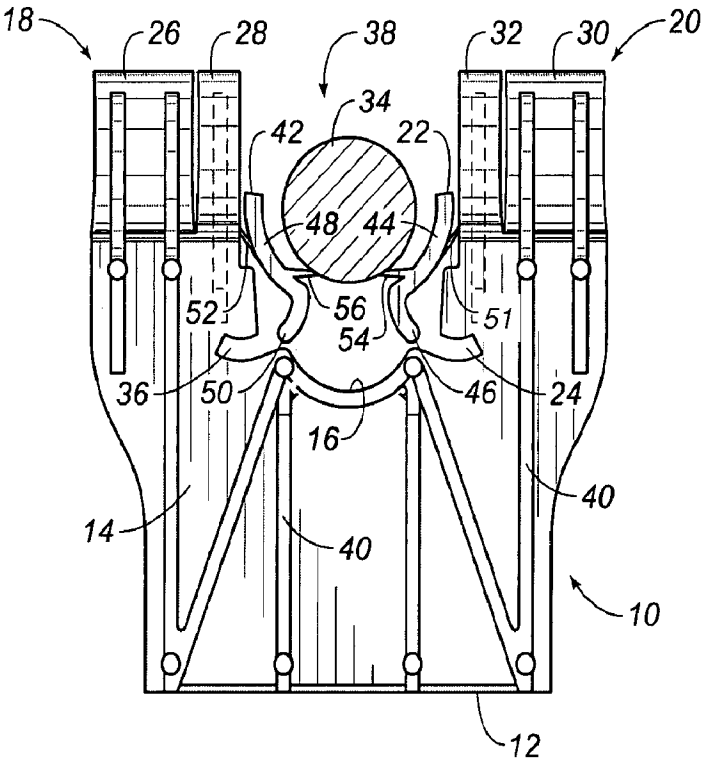
FIG. 2 is an end view illustrating the retainer members of the present invention extending in their first position.
Figure 4:
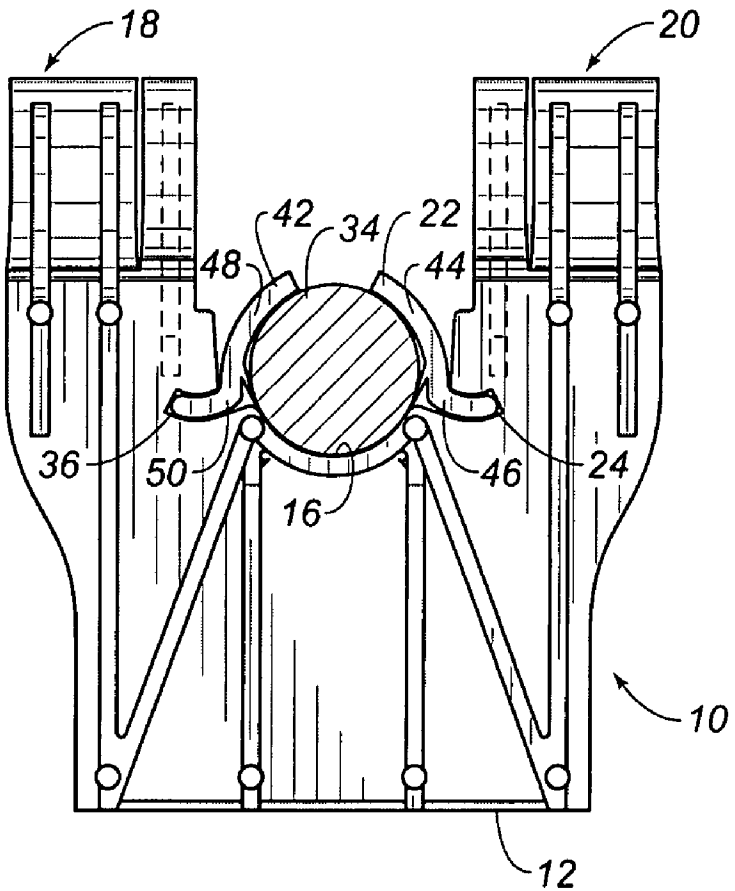
FIG. 4 is an end view of the present invention illustrating the rebar in its second position as received within the channels and with the retainer members overlying a portion of the top of the rebar.
Figure 3:
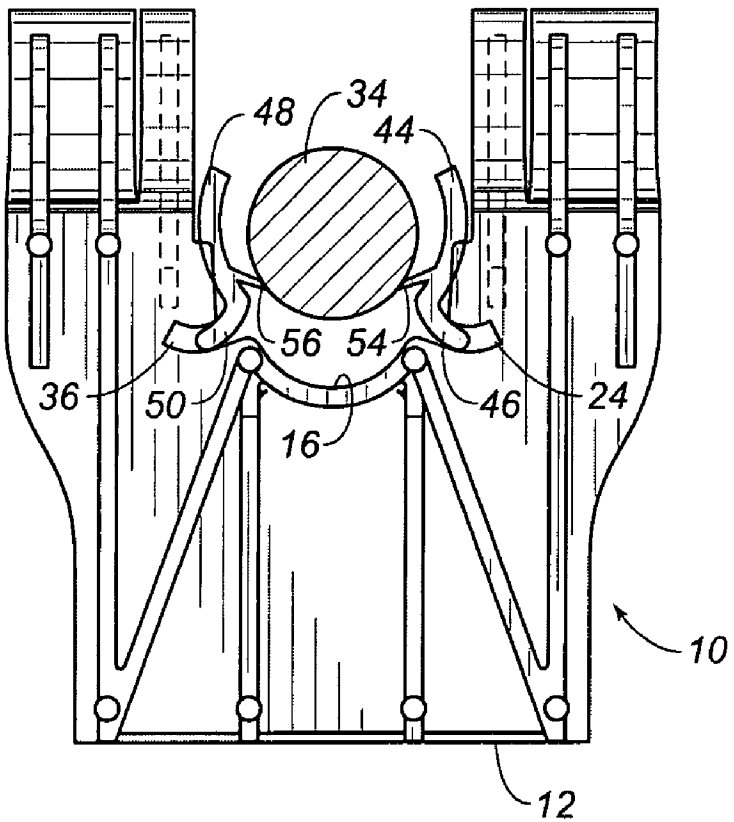
FIG. 3 is an end view of the present invention showing the retainer members in an intermediate position during the movement of the rebar toward the channel.

The present invention provides a unique technique for retaining the rebar within the channel 16 and between the clamping structures 18 and 20. FIGS. 2-4 illustrate the structure and method of the present invention for retaining rebar 34 with the channel 34 within the channel 16. FIG. 2 illustrates a first position of the rebar relative to the channel 16. FIG. 3 illustrates an intermediate position of the rebar 34 relative to the channel 16. FIG. 4 illustrates the second position whereby the rebar 34 is retained within the channel 16.

In FIG. 2, it can be seen that the bar support 10 includes base 12, support structure 14, first clamping structure 18 and second clamping structure 20. Also, in FIG. 2, it can be seen that the first curved element 26 is offset in the longitudinal direction of the second rebar from the second curved element 28. Also, in FIG. 2, it can be seen that the first curved element 30 is offset from the second curved element 32 along the longitudinal direction of the rebar that would be retained therebetween. Slot 36 is formed adjacent to the first clamping structure 18 and adjacent to the channel 16. Slot 24 is formed adjacent to the second clamping structure 20 and adjacent to the channel 16. Slots 24 and 36 are slightly curved and open into the receiving area 38 into which the rebar 34 is introduced. A plurality of various ribs 40 extend along the surface of the support structure 14 to provide structural integrity for the support structure 14.

Importantly, in FIG. 2, it can be seen that there is a first retainer member 22 and a retainer member 42. The retainer member 42 is positioned adjacent to the first clamping structure 18. The retainer member 22 is positioned adjacent to the second clamping structure 20. Each of the retainer members 22 and 42 has a generally S-shaped cross-section construction. The retainer member 22 includes an upper curved section 44 and a lower tail section 46. The retainer member 42 includes an upper curved section 48 and a tail section 50. A tang 51 serves to secure the upper curved section 44 of the retainer member 22 against the clamping structure 20 of the bar support 10. Similarly, a tang 52 serves to detachably retain the retainer member 42 in an upward position and against the clamping structure 18. Tangs 51 and 52 have suitable strength so as to retain the retainer members 22 and 42 in an upward position while, at the same time, being suitably breakable or frangible so as to detach from the respective retaining surfaces 20 and 18 when a suitable force is applied to the retainer members 22 and 42 by the downward movement of the rebar 34. The tang 51 extends outwardly from the backside of the upper curved section 44 of retainer member 22. The tang 52 extends outwardly from the back surface of the upper curved surface 48 of the retainer member 42. A finger 54 extends from the curved surface 44 of the retainer member 22 in a direction toward the curved surface 48 of the retainer member 42. A finger 56 extends from the curved surface 48 of the retainer member 42 toward the curved surface 44 of the retainer member 22. A shoulder is formed between the curved section 44 and the tail section 46 of the retainer member 22. Similarly, a shoulder is formed between the curved section 48 and the tail section 50 of the retainer member 42.

FIG. 2 illustrates the first position in which the rebar 34 is introduced into the receiving area 34 between the clamping structures 18 and 20. In the position illustrated in FIG. 2, a bottom surface of the rebar 34 will contact the fingers 54 and 56 of the retainer members 22 and 42. In this position, the tail sections 46 and 50 are respectively free of the slots 24 and 35. The curved sections 44 and 48 of the retainer members 22 and 42 are suitably spaced apart from each other so that the rebar 34 can be introduced therebetween. The tangs 51 and 52 serve to retain the retainer members 22 and 42 in the orientation illustrated in FIG. 2.

In FIG. 3, it can be seen that the rebar 34 has assumed an intermediate position while approaching the channel 16. In this arrangement, the fingers 54 and 56 are urged downwardly in the direction toward the channel. The tail sections 46 and 50 start to enter the respective slots 24 and 36. The forces imparted by the rebar 34 upon the fingers 54 and 56 (along with the shoulders that are formed between the respective curved sections and tail sections), cause the movement of the tail sections 54 and 56 into the respective slots 24 and 36.

In FIG. 4, it can be seen that the rebar 34 is positioned in surface-to-surface contact with the surface of the channel 16. In this position, the tangs 51 and 52 have been detached from contact with the respective clamping structures and 20 and 18. This freedom of movement causes the tail sections 46 and 50 to respectively enter and be received entirely within the slots 24 and 36. The curved nature of the tail sections 46 and 50 and the curved nature of the slots 24 and 36 establish a strong fit therebetween. The upper curved sections 44 and 48 of the retainer members 22 and 44 now overlie a portion of the top of the rebar 34. Since the curved sections 44 and 48 extend the sides of the rebar 34 from more than half of the diameter of the rebar 34, the retainer members 22 and 44 will effectively and strongly retain the rebar 34 against the surface of the channel 16. The reception of the tail sections 46 and 50 within the respective slots 24 and 36 will strongly resist any separation between the retainer members 22 and 42 caused by any upward movement of the rebar away from the surface of the channel 16. Similarly, the strong contact between the back surfaces of the retainer members 22 and 24 with the sides of the clamping structures 20 and 18, respectively, will resist any deflection of the retainer members 22 and 24 and avoid inadvertent release of the rebar 34.

I claim:

1. A concrete reinforcing bar support comprising:

a base;

a support structure extending upwardly from said base, said support structure having a channel formed at an upper surface thereof, said channel extending in a direction and having a size suitable for receiving a first rebar therein;

a first clamping structure affixed to said support structure on one side of said channel and having a surface suitable for receiving a second rebar therein extending in a direction transverse to the first rebar;

a second clamping structure affixed to said support structure on an opposite side of said channel, said second clamping structure having a surface suitable for receiving the second rebar therein; and a rebar retaining means positioned between said first and second clamping structures for retaining the first rebar in said channel, said rebar retaining means comprising:

a first retainer member positioned adjacent said first clamping structure; and a second retainer member positioned adjacent said second clamping structure, each of said first and second retainer members movable between a first position spaced away from each other and a second position overlying a portion of the first rebar when the rebar is placed in said channel, each of said first and second retainer members comprising:

a generally S-shaped cross-section member with a curved section and a tail section, said support structure having a slot formed therein adjacent each of said first and second clamping structures, said tail section received within said slot when the retainer member is in said second position.

2. The bar support of claim 1, said S-shaped cross-section member being detachably secured to the clamping structure when in said first position so as to define a space between said first and second retainer members such that the first rebar can be introduced between said first and second retainer members.

3. The bar support of claim 2, each of said first and second retainer members further comprising:

a tang affixed to a back surface of the retainer member and to the clamping structure, said tail section being free of said slot in said first position.

4. The bar support of claim 2, said S-shaped cross-section member having a finger extending outwardly from a surface thereof into said space between said first and second retainer members, said finger contacting a surface of the rebar as the rebar is moved toward said channel.

5. The bar support of claim 1, each of said first and second clamping structures comprising:

a first curved element extending upwardly from said support structure; and a second curved element extending upwardly from said support structure, said first curved element facing said second curved element so as to define a rebar-receiving space therebetween.

6. The bar support of claim 5, said first curved element being offset from said second curved element along a longitudinal direction of the second rebar.

7. The bar support of claim 1, said base, said support structure, said first and second clamping structures and said rebar retaining means being integrally formed together of a polymeric material.

* * * * *